US005586377A

United States Patent [19]

Katsuta et al.

[11] Patent Number: 5,586,377

[45] Date of Patent: Dec. 24, 1996

[54] SYSTEM FOR COVERING A CUSHION MEMBER WITH A TRIM COVER ASSEMBLY

[75] Inventors: Kazuo Katsuta; Tadafumi Abe, both Akishima, Japan

[73] Assignee: Tachi-S Co., Ltd, Tokyo, Japan

[21] Appl. No.: 351,103

[22] Filed: Nov. 30, 1994

[51] Int. Cl.[6] ..... B68G 7/00

[52] U.S. Cl. ..... 29/91.5; 29/448; 29/281.4; 29/281.3; 297/218.2

[58] Field of Search ..... 29/91.5, 91, 448, 29/281.1, 281.3, 281.4; 297/218.2

[56] References Cited

U.S. PATENT DOCUMENTS

| | | | |
|---|---|---|---|
| 4,643,480 | 2/1987 | Morita | 297/218 |
| 4,675,962 | 6/1987 | Tillner et al. | 29/91.1 |
| 4,691,963 | 9/1987 | Mikuniya et al. | 297/195 |
| 4,867,507 | 9/1989 | Arai | 297/218 |
| 4,913,071 | 4/1990 | Kawasaki | 112/152 |
| 5,287,610 | 2/1994 | Gomolak et al. | 29/91.1 |
| 5,398,393 | 3/1995 | Bentschneider | 29/91.5 |

*Primary Examiner*—S. Thomas Hughes

*Assistant Examiner*—Marc W. Butler

*Attorney, Agent, or Firm*—Browdy and Neimark

[57] ABSTRACT

A system for covering a cushion member with a sack-like trim cover assembly, which includes a securing mechanism with support element and a covering guide mechanism. The sack-liked trim cover assembly is turned inside out and secured on the securing mechanism, with the cushion member secured thereon in an opposedly faced relation with such turnedover trim cover assembly. Both cushion member and trim cover assembly are located precisely by the support element at a given position on the securing mechanism. The securing mechanism and covering guide mechanism are operated in a direction opposite to each other, thereby displacing the cushion member to an opened side of the trim cover assembly, while the trim cover assembly is being turned over again by the covering guide mechanism. The system further includes a pressing device for pressing a part of the cushion member to make it accesible for securement of an anchor member of the trim cover assembly therewith so that the cushion member is neatly covered with the trim cover assembly. A hog ring fitting mechanism is provided for automating such securement of anchor member to the cushion member, which permits all the operations of the system to be effected automatically.

12 Claims, 10 Drawing Sheets

SYSTEM FOR COVERING A CUSHION MEMBER WITH A TRIM COVER ASSEMBLY

BACKGROUND OF INVENTION

1. Field of the Invention

The present invention relates to a system for automatically covering a seat-frame-built-in foam cushion member with a trim cover assembly in order to produce an automotive seat, wherein the foam cushion member has been foamed together with a seat frame in a mould into a given shape of the seat, and wherein the trim cover assembly is of a sack-like type which is preformed by cover member(s) into an integral three-dimensional sack-like configuration having an opening at one side thereof.

2. Description of Prior Art

In general, the automated assemblage of an automotive seat involves using a sack-like trim cover assembly to cover a foam cushion member therewith because of its being suited for the automated process, wherein the foam cushion member has been foamed together with a seat frame in a mould into a predetermined shape of automotive seat. What will be described hereinafter as the "sack-like trim cover assembly" is the integrally preformed solid trim cover assembly having one opening at one side thereof, assuming a "sack" shape, which is preformed by a unitary tubular cover member or a few separate parts of cover members into an integral sack-like configuration having an opening defined in the lower end thereof, a closed top area defined in the upper end thereof and a tubular body portion defined between the opening and closed top area, all of which are formed integrally.

Commonly, in automated covering process, it is an ordinary first step to have such sack-like trim cover assembly turned inside out from the opening thereof in advance, to thereby provide a turned-over suck-like body of trim cover assembly and expedite covering the cushion member therewith, simply by turning again over the trim cover assembly towards the cushion member.

Conventionally, such covering process has been effected by an automated covering system or device having a set of spaced-apart forward and backward guide rollers, each being adapted to guide and turn over the respective forward and backward lateral sides of the foregoing turned-over sack-like trim cover assembly in a direction toward the corresponding forward and backward surfaces of a foam cushion member, as typically disclosed by the Japanese Laid-Open Patent Pub. No. 59-32490 and the Japanese Laid-Open U.M. Pub. No. 63-38900. According thereto, a foam cushion member is set in a manner turned upside down at a position right above the opened side of a turned-over sack-like trim cover assembly, and then lowered thereinto with the aid of those guide rollers, while again causing the trim cover assembly to be turned over, so as to cover the cushion member therewith.

However, in the conventional covering system, there is no means for locating the opened side of the trim cover assembly precisely at a point corresponding to a given upper end portion of the cushion member, before the foregoing covering process. This has been found defective in that the trim cover assembly may highly possibly be dislocated to any of four angles from a predetermined covering position, making thus difficult a precise covering of the cushion member with the cover material at that position. Further, the above-mentioned prior-art covering systems are not used to neatly affix the trim cover assembly over such an unevenly-surfaced cushion member having a recessed central area and two lateral bolster portions, because they merely effect a simple covering operation to the cushion member without any mechanism for aiding in the neat stretching of trim cover assembly over the uneven outer shape of cushion member in close contact thereupon. Consequently, there has not been available any automated covering system for realizing both the precise locating of trim cover assembly to cushion member and the neat covering of unevenly-surfaced cushion member.

SUMMARY OF THE INVENTION

In view of the above-stated drawbacks, it is therefore a primary purpose of the present invention to provide an improved system for covering a cushion member with a sack-like trim cover assembly, which permits for not only insuring to precisely locate the cushion member at a given position with respect to an opened side of such sack-like trim cover assembly, but also achieving a neat covering of an uneven outer configuration of the cushion member with the trim cover assembly.

In order to attain such purpose, a system in accordance with the present invention utilizes a foam cushion member and a sack-like trim cover assembly with an anchor means provided in the inside surface thereof, and basically comprises:

- a temporary securing mechanism provided with a support means, on which temporary securing mechanism, an upper end of the cushion member and a top section of the trim cover assembly are temporarily secured via the support means at a predetermined position, wherein the trim cover assembly is turned inside out in advance before being secured on the temporary securing mechanism;
- a covering guide mechanism for supportingly guiding said trim cover assembly which is temporarily secured on the temporary securing mechanism and turning the same over onto four side surfaces of the cushion member, which guide covering mechanism includes a forward guide means disposed forwardly of the temporary securing mechanism, a rearward guide means disposed rearwardly of the same temporary securing mechanism and a lateral guide means disposed on both lateral sides of the temporary securing mechanism;
- a cushion member securing mechanism for securing and supporting the cushion member; and
- a means for pressing the cushion member to make accessible a predetermined area of the same in which the anchor means provided in the trim cover member is to be secured.

Accordingly, both cushion member and trim cover assembly are secured on the temporary securing mechanism with the supporting aid of such support means, avoiding thus accidental relative dislocation between the cushion member and trim cover assembly, and in operation, the temporary securing mechanism, covering guide mechanism, cushion member securing mechanism and cushion member pressing means are actuated to cause the cushion member to be covered with the trim cover assembly, while permitting the anchor means to be secured to the predetermined area of cushion member. The anchor means serves to forcibly bring the trim cover assembly to a close contact upon the surfaces of cushion member. Thus, the cushion member is precisely and neatly covered with the trim cover assembly.

It is more preferable to use a foam cushion member having a headrest stay holder provided in the upper end thereof and a sack-like trim cover assembly having a hole formed in the top section thereof in correspondence with that headrest stay holder. In that case, the support means may be comprised of a support rod that can be inserted into both the headrest stay holder and holes. This makes more positive the precise locating of cushion member with respect to the trim cover assembly, and also eliminates the need for preparing a special separate element for that particular purpose.

As one mode of the present invention, the temporary securing mechanism, covering guide mechanism, cushion member securing mechanism and cushion pressing means may be disposed independently of each other upon a framework, with such an arrangement that the temporary securing and cushion member securing mechanisms are operated together in one direction so as to displace both cushion member and trim cover assembly in that direction, while by contrast, the covering guide mechanism is operated in another direction opposite to such one direction, whereby the trim cover assembly may be guided and turned over onto the four side surfaces of cushion member.

As another mode of the invention, a hog ring fitting mechanism may be incorporated in the above-described structure in order to automatically secure the anchor means to the aforesaid predetermined area of cushion member via a hog ring, so that operation of the mechanisms and means stated above may be automatically effected without the manual step of securing the anchor means to the cushion member. In this case, an insert wire may preferably be provided in the predetermined area of cushion member, and the hog ring fitting mechanism may preferably comprise a hog ring device having a jaw portion and a hook device disposed forwardly of the jaw portion of hog ring device. With such an arrangement, in operation, after the cushion pressing means has been operated in a first direction to press the predetermined area of cushion member, making accessible the insert wire, the hook device is operated to hookingly catch and retain the anchor means in front of the hog ring device. Thereafter the hog ring device is operated in a direction towards such first direction, extending the jaw portion thereof over both anchor means and insert wire and fitting a hog ring around them.

Preferably, each of said forward, rearward and lateral means may comprise an upright standing guide plate member having two upper cut-away corner portions, and a pair of rollers, each being rotatably supported in the respective two upper cutaway corner portions of guide plate member.

Other features and advantages of the present invention will become apparent from reading of description hereinafter, with reference to the annexed drawings.

DETAILED DESCRIPTION OF PREFERRED EMBODIMENT OF THE INVENTION

Referring to FIGS. 1 to 10, there is illustrated one preferred embodiment of an automated system for covering a cushion member with a trim cover assembly in accordance with the present invention.

Figure 10:
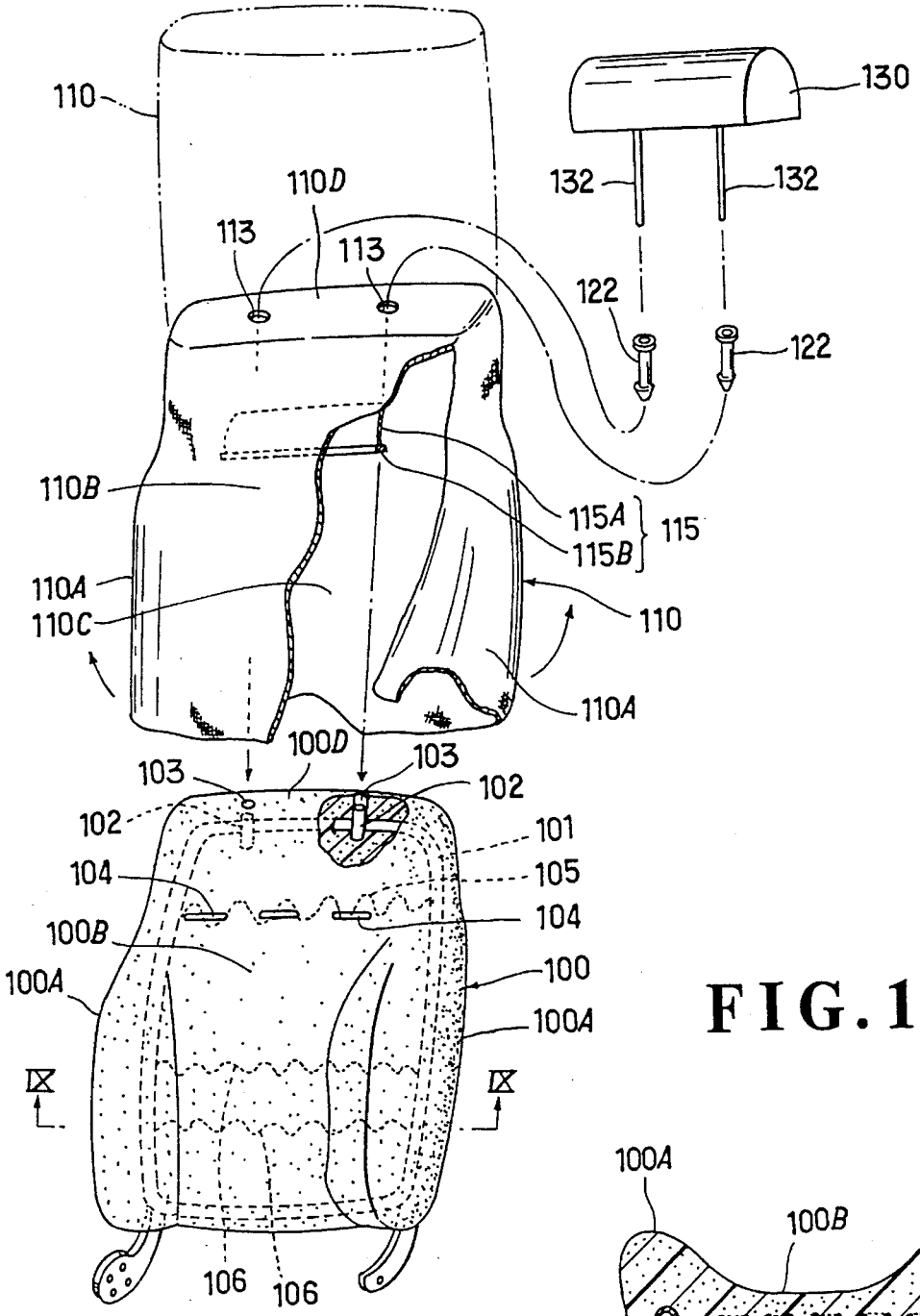
FIG. 10 is a partly broken, exploded schematic perspective view of a product to be formed by the system.
Figure 11:
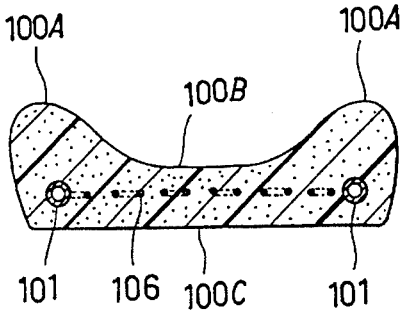
FIG. 11 is a section view taken along the line IX—IX in FIG. 10.

Reference is now made particularly to FIG. 10, which shows basic constituent elements for forming a seat back (SB)of an automotive seat. The FIG. 10 also schematically indicates some steps for forming the seat back (SB) by way of the one-dot chain line arrows and solid arrows.

The assemblage of such seat back (SB) has to be carried out basically in a similar covering steps to the steps stated in the previous description of prior art. That is, as indicated in FIG. 10, the sack-like trim cover assembly (110) should firstly be turned inside out from the opened side thereof into a reversed state shown by the two-dot chain line, and therafter the thus-turned-over trim cover assembly (110) be again turned inside out onto the side surfaces of a foam cushion member (100), thus finishing the covering of cushion member (100). But, in accordance with the present invention, there is provided an optimal system permitting for fully automated or two-step operation mode for executing such covering processes, with effective solutions to the drawbacks of the prior art, the details of which will however be elaborated later.

Looking again at FIG. 10, in accordance with the present invention, the foam cushion member (100) is of a typical seat back shape having a pair of outwardly swollen lateral bolster portions (100A) and a central recessed area (100B) defined therebetween, in which a passenger may be supported from both lateral sides, and also of a seat-frame-built-in type having a seat back frame (101) embedded therein, with a pair of spaced-apart stay holder support tubes (102) provided fast on the upper frame part of the seat back frame (101). As will be described later, two stay holders (122) and headreas stays (132) (see FIG. 10) are inserted into those two support tubes (103), respectively. Thus, as shown in FIG. 10, the cushion member (100) has recessed frontal side (at 100B) and flat rear side (100C), assuming an unevenly surfaced cushion body difficult to be covered neatly with the sack-like trim cover assembly (110), to which the present invention is directed.

Two through-bores (103) are formed in the top portion (100D) of the cushion member (100) such as to communicate with the two support tubes (102), respectively. A sinuous insert wire (105) is embedded within the cushion member (100) at the upper part thereof and extended between both lateral frame sections of the seat back frame (101). Designations (106) each denotes a sinuous spring for giving an additional elastic support to the lower part of cushion member (100).

Figure 9:
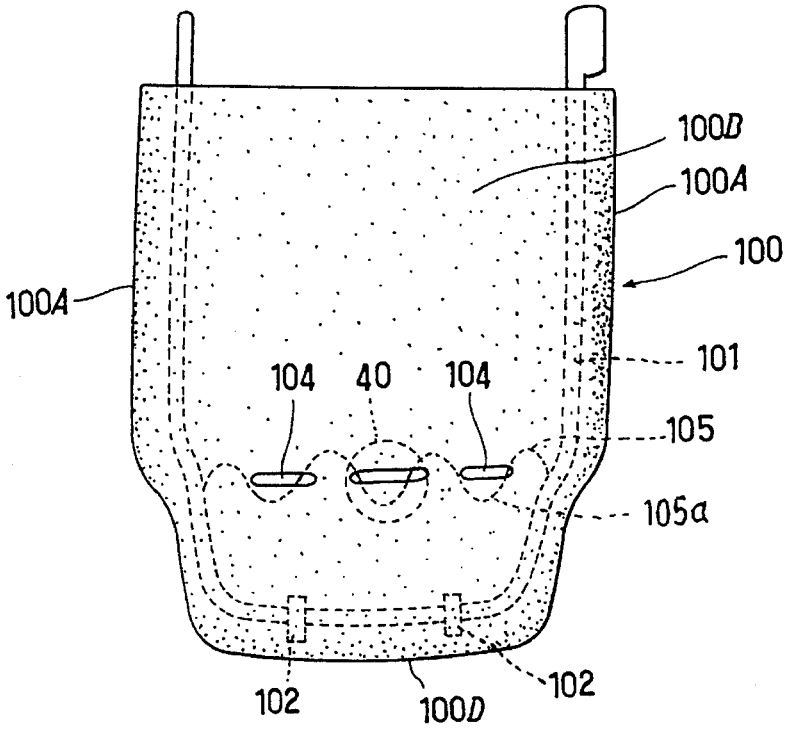
FIG. 9 is a front view of the cushion member.
Figure 12:
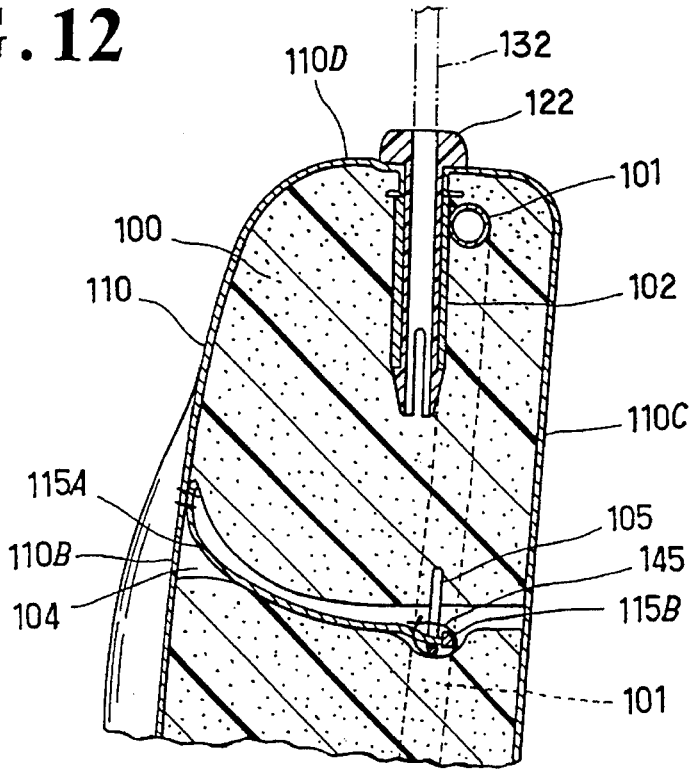
FIG. 12 shows the result of the process of FIG. 8.

At least two slits (104) are formed in the upper part of cushion (100), penetrating therethrough as shown in FIG. 12 and arranged alongside of the sinuous insert wire (105) such that they are respectively defined in correspondence with two downward valley portions of the insert wire (105). Preferably, as best shown in FIG. 9, each slit (104) should be defined at a point slightly above the lower end of corresponding valley portion (105*a*) of sinuous spring (105) for a hog ring securing purpose to be described later. It is noted that the cushion member (100) is preformed into the illustrated shape by foaming a base foamable material together with all the above-mentioned elements (101, 102, 105, 106) in a mould.

The sack-like trim cover assembly (110) is formed in a shape generally corresponding to that of the cushion member (100), which has, defined therein, a frontal central section (110B), a pair of lateral bolster sections (110A) and a top section (110D), thus providing an opening at the lower end side of the trim cover assembly (110) opposite to the top section (110D) as can be seen from FIG. 10. Fixed to the inner surface of the frontal section (110B) is an anchor member (115) which comprises an anchor cloth (115A), the base end of which is sewn or fixed to the reverse side of the trim cover assembly (110), and an anchor head (115B) of a rectangular cross-section fixed to a free end of the anchor cloth (115A). Two spaced-apart holes (113) are formed in the top section (110D) of trim cover assembly (110) such that they are each disposed in alignment with the respective two through-bores (103) of cushion member (100).

The covering system according to the invention is essentially comprised of: a temporary securing mechanism for temporarily securing both upper end parts respectively of the trim cover assembly (110) and cushion member (100); a covering guide mechanism for guiding and tucking up the turned-over trim cover assembly (110) along the four side surfaces of cushion member (100); a cushion member securing mechanism for securing the lower end of cushion member (100); and a hog rind fitting mechanism for fitting securely hog rings (145) (see FIG. 12) about the insert wire (105) for the purpose of securing the anchor member (115) to the same insert wire (105).

Figure 1:
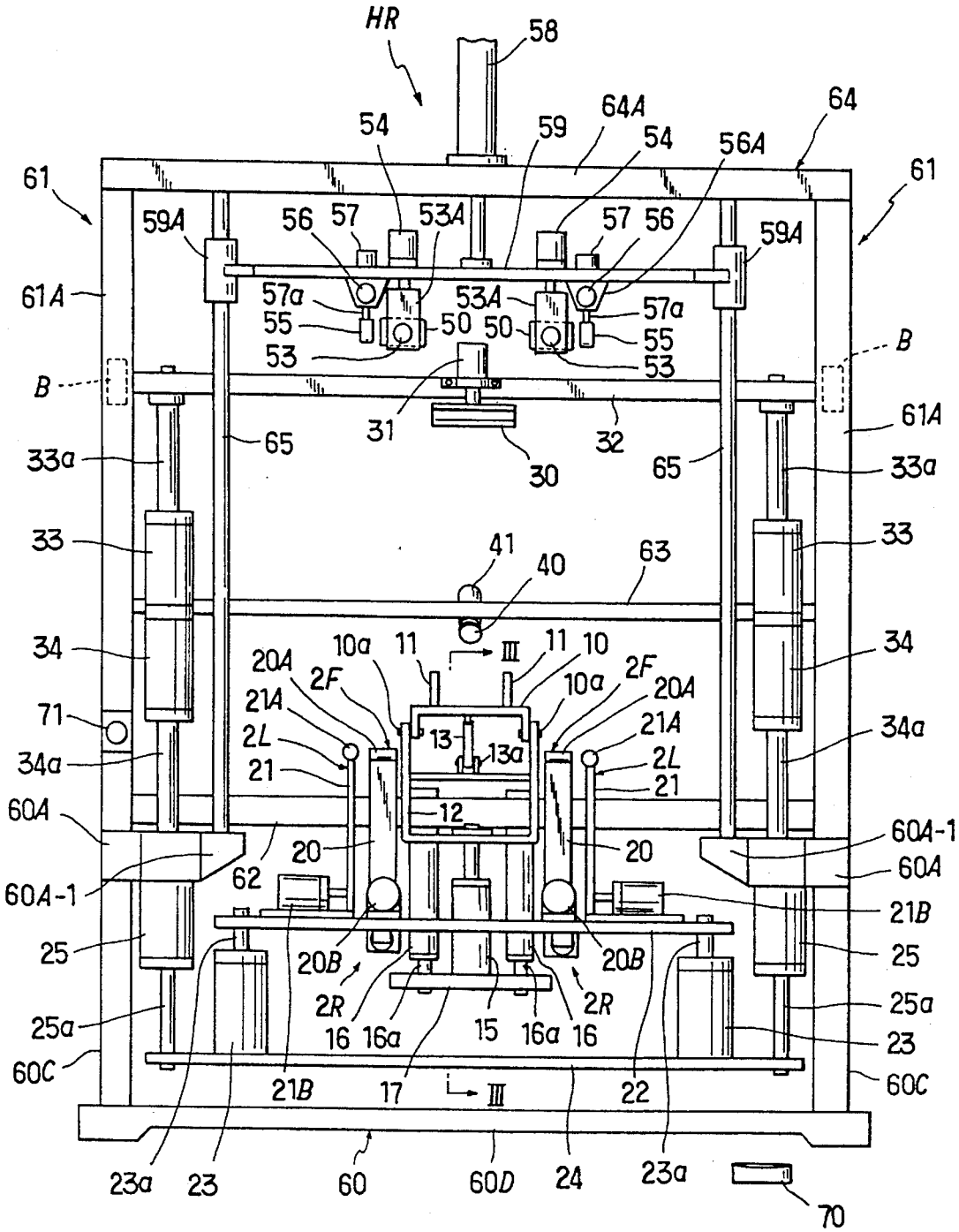
FIG. 1 is a schematic front view of a system in accordance with the present invention.
Figure 2:
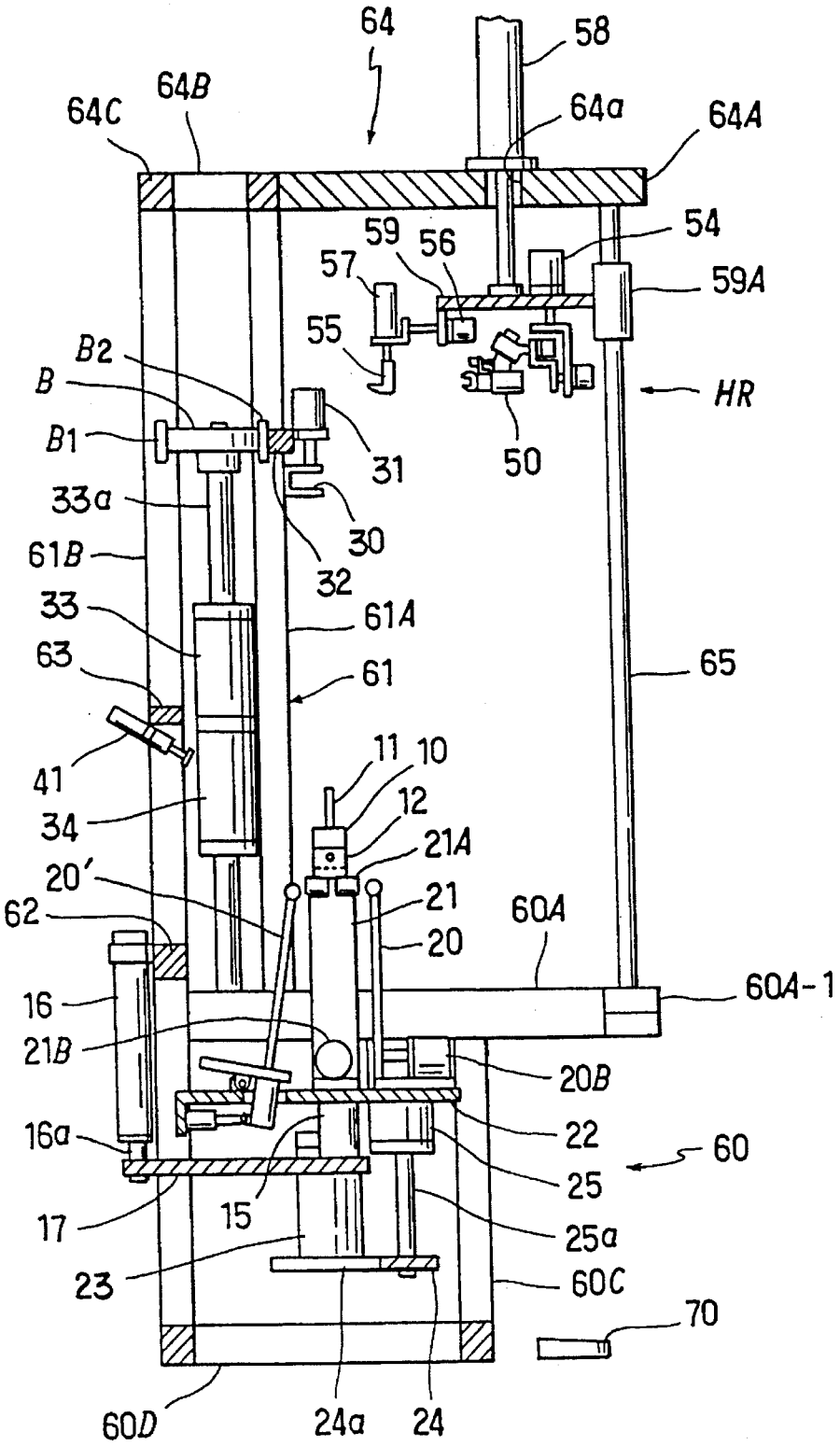
FIG. 2 is a schematic, longitudinal sectional view of the system.

As shown in FIGS. 1 and 2, the covering systems has a rectangular framework comprising an upper framework (64), a lower base framework (60) and a pair of lateral frameworks (61), with first and second crossover frames (63) (62) extended between that pair of lateral frameworks (61). As best seen in FIG. 2, the upper framework (64) is formed by a forward horizontal plate frame section (64A), and a rearward frame section (64C) and two crossover frame sections (64B) (64B)(only one of them is viewed from the FIG. 2) which connect the forward plate frame section (64A) with the rearward frame sections (64C). The pair of lateral frameworks (61) are each formed by forward and rearward vertical frame sections (61A) (61B), each being of a channel cross-section which serves to provide a recessed guide groove. The foregoing first and second crossover frame sections (63) (62) are extended and fixed between the two rearward vertical frame sections (61B), as best shown in FIGS. 1 and 2. The lower base framework (60) is formed by a pair of horizontal lateral frame sections (60A), a pair of forward vertical frame sections (60C), a base frame section (60D), and a lower extension of the foregoing rearward vertical frame section (61B) respectively of two lateral frameworks (61).

As in FIG. 2, both forward horizontal plate frame section (64A) and paired horizontal lateral frame sections (60A) project forwardly in parallel with each other. Each of the lateral frame sections (60A) is formed, at its forward free end, with an inwardly projected support frame (60A-1). A pair of guide rods (65) are extended respectively between plate frame sections (64A) (60A) and support frames (60A-1).

The hog ring fitting mechanism, as designated generally by (HR), is supported on forward horizontal plate frame section (64A) and guide rods (65). Namely, the hog ring fitting mechanism (HR) basically comprises a cylinder (58), a horizontal plate member (59) fixed to the cylinder rod of the cylinder (58). The horizontal plate member (59) has a pair of cylindrical guide members (59A) formed integrally at both ends thereof, each of them being slidably fitted about the respective pair of guide rods (65). The hog ring fitting mechanism further comprises a pair of spaced-apart hog ringer assemblies, each including a known hog ringer device (50), a hook device (55) and several cylinders (53, 54, . . . ) and being mounted on the plate member (59), so that the hog ringer assemblies may be vertically displaced by operation of the cylinder (58).

Figure 7:
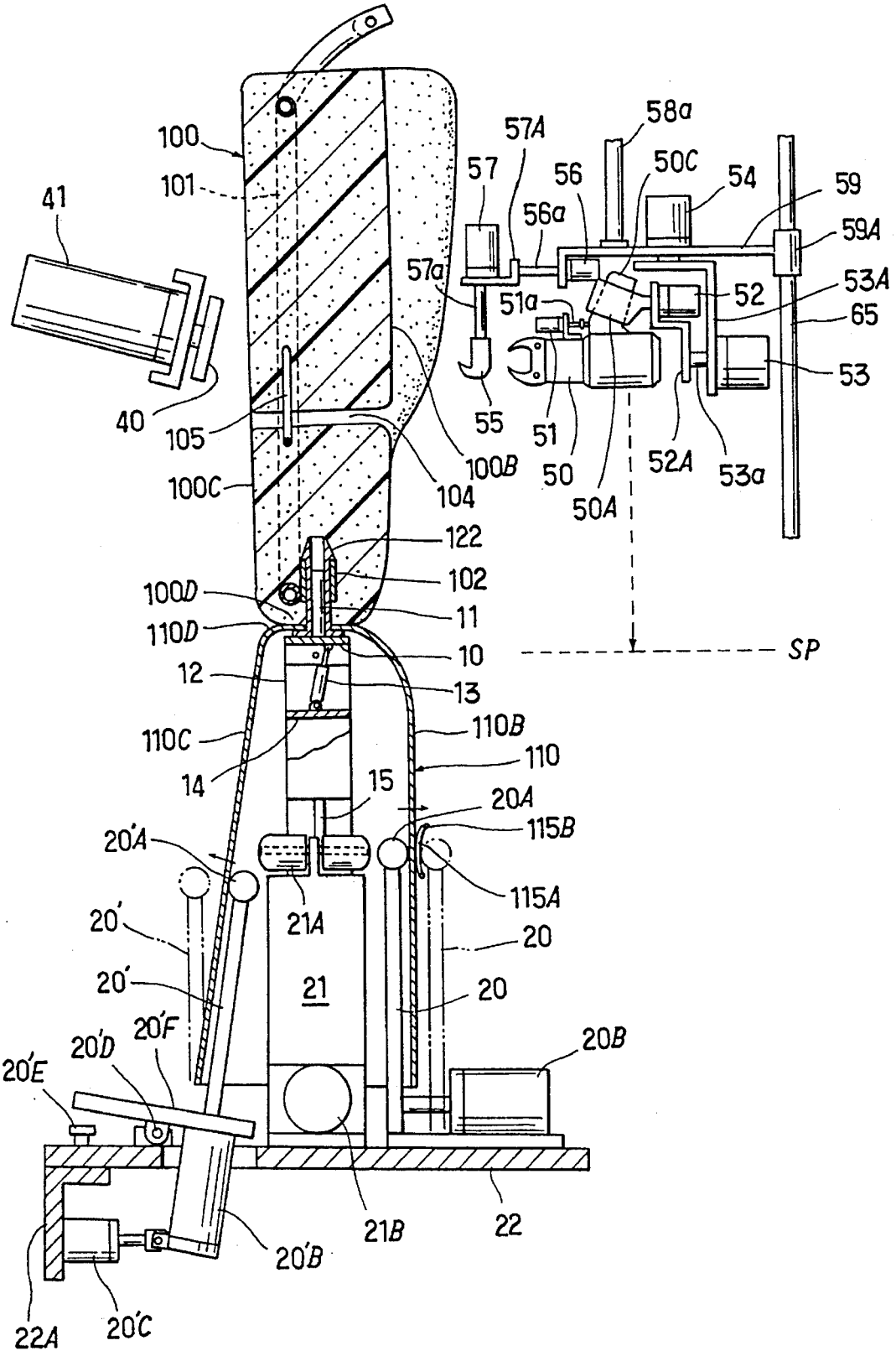
FIG. 7 is a partly broken, longitudinal sectional side view which shows some principal parts of the system.

As best seen in FIG. 7, each of the hog ringer assemblies is composed of: a hog ringer device (50) (the shown hog ringer device is "WCA-3 Hog Ringer Model 1500" available from the Rotor Tool Company, Cleveland, Ohio, U.S.A.); a hog ringer holder (50A) for firmly holding a handle of the hog ringer device (50); a trigger cylinder (51) fixed on the hog ringer device (50), which has a cylinder rod (51*a*) connected to a trigger switch portion of the hog ringer device (50); a pair of first and second horizontal transfer cylinders (53) (52) for causing two-step fore-and-aft displacement of the hog ringer device (50), wherein the second cylinder (52) is supportingly connected via a bracket (52A) with the cylinder rod (53*a*) of the first cylinder (53) and wherein further the same cylinder (52) is connected to the hog ringer holder (50A); an elevation cylinder (54) fixed on the plate member (59), which is connected with the two horizontal transfer cylinders (53) (52) and adapted to cause vertical displacement of the hog ringer device (50); and a hook device (55) having an elevation cylinder (57) and a horizontal transfer cylinder (56), wherein a hook member (i.e. at 55) is fixed to the cylinder rod (57*a*) of the elevation cylinder (57) and wherein that elevation cylinder (57) is in turn connected via a bracket (57A) to the cylinder rod (56*a*) of the horizontal transfer cylinder (56) fixed on the plate member (59), whereby the hook member may be displaced of fore-and-aft and vertical directions by operation of the two cylinders (56) (57). As will be explained later, the hook device (55) is operable to catch and transfer the anchor member (115) into the slit (104) before the hog ringer device (50) is operated.

Designations (40) (41) denote a disc-like pressure plate and a cylinder for the pressure plate (40), respectively. As in FIG. 2, the cylinder (41) is fixed at the midway part of the first crossover frame section (63) and inclined downwardly. The pressure plate (40) may be advanced and withdrawn by operating the cylinder (41) in order to press a given point (see the designation (SP) in FIG. 5) of the cushion member (100), facilitating the hog ring fitting operation of the above-stated hog ringer assemblies, which will also be described in detail later.

Designation (32) denotes a movable frame which has, provided at its both ends, a roller assembly (B) having two rollers (B1) (B2). Each of the two rollers (B1) (B2) is fitted rotatably in the previously mentioned recessed guide grooves defined in each of the vertical frame sections (61A) (61B) associated with the lateral framework (61).

The movable frame (32) may be moved vertically along the longitudinal direction of the vertical frame sections (61A) (61B) by operation of a pair of spaced-apart dual cylinders, each comprising upper and lower cylinders (33) (34). The two dual cylinders are provided respectively between both end portions of the movable frame (32) and two horizontal lateral frame sections (60A), as shown in FIG. 1, such that each cylinder rod (33*a*) of upper cylinder (33) is fixed opposite ends of movable frame (32), while each cylinder rod (34*a*) of lower cylinder (34) is fixed to the support frame (60A-1).

A cushion member securing device (30) and its associated cylinder (31) are fixedly mounted at the midway part of the movable frame (32), forming the cushion member securing mechanism referred to above as one of the constituent elements of the present covering system. Although not clearly shown, the securing device (30) itself may be a known suitable clamp for retaining the lower end of cushion member (100), as can be seen from FIG. 5.

Figure 3:
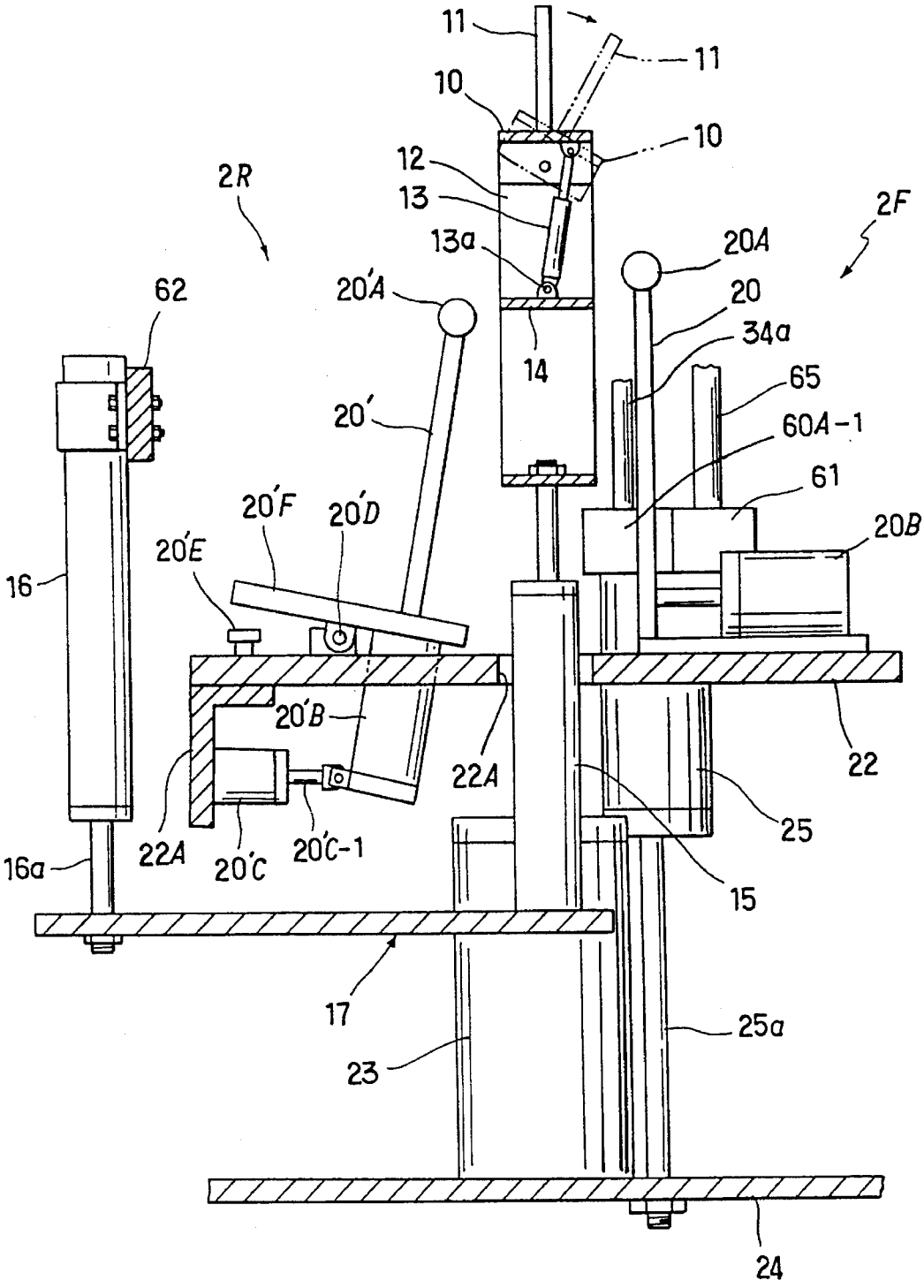
FIG. 3 is a sectional view taken along the line III—III in FIG. 1.
Figure 5:
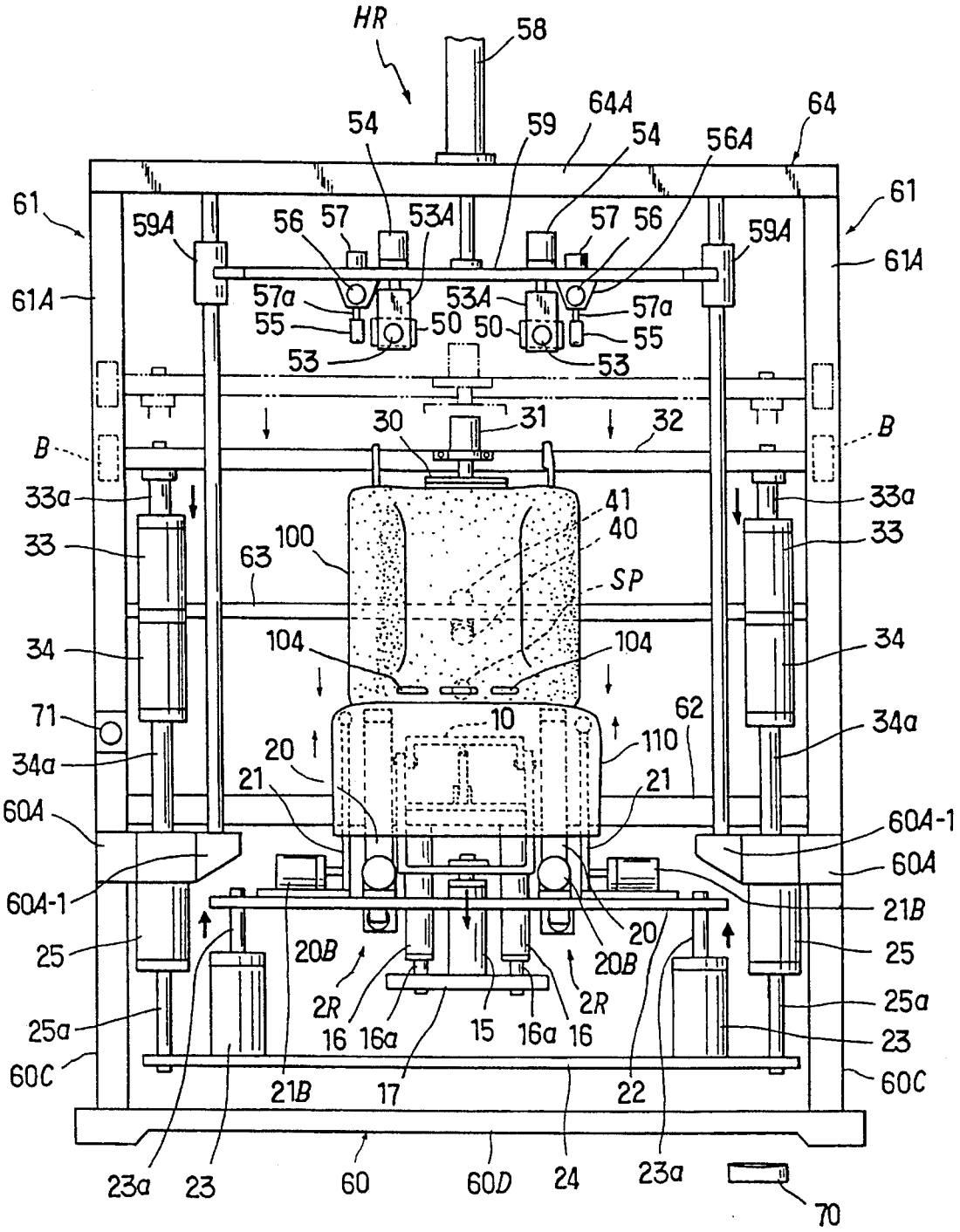
FIG. 5 is a schematic front view of the system, showing its operation state for covering the cushion member.

Further, according to the present invention, as a means for forming the above-referred temporary securing mechanism, there is provided an inclinable securing bracket (10) on which are fixed a pair of spaced-apart support rods (11) projecting therefrom. It is noted here that the distance between the two support rods (11) is equal to that between the two holes (113) of the trim cover assembly (110) as well as that between the two through-bores (103) for the temporary securing purpose to be set forth later. The inclinable securing bracket (10) is pivoted at its both ends to the respective two upper ends of a U-shaped base bracket (12) and allowed to be inclined forwardly and backwardly relative to the base bracket (12) by operation of a cylinder (13). As best shown in FIG. 3, the lower base end of such cylinder (13) is rotatably connected via a bracket (13*a*) to a support plate (14) extended midway between the two lateral sections of the base bracket (12). The cylinder rod of the same cylinder (13) is pivotally connected to the reverse side of the inclinable securing bracket (10). As in FIG. 3, the inclinable securing bracket (10) may be rotated between a vertical securing position shown by the solid line and a forwardly inclined ready position shown by the two-dot chain line. In the vertical securing position, both securing bracket (10) and support rods (11) project from the base bracket (12) to thereby secure and support the trim cover assembly (110) and cushion member (100) in an upright state, as can be seen in FIG. 5 or 7. On the other hand, in the forwardly inclined ready position, the support rods (11) are inclined forwardly in a state ready to permit the two elements (110) (100) to be secured thereto, as will be elaborated later.

The base bracket (12) is supported on the cylinder rod (15*a*) of a first cylinder (15) fixed on a base plate (17). The base plate (17) is connected to a pair of second cylinders (16) fixed to the second crossover frame (62), as best shown in FIG. 2. Thus, operating the first and second cylinders (15) (16) causes both inclinable securing bracket (10) and base bracket (12) to be moved upwardly and downwardly within the frameworks.

Furthermore, according to the invention, as a means for forming the above-mentioned covering guide mechanism, there are provided a forward guide mechanism (2F), a rearward guide mechanism (2R) and a pair of lateral guide mechanisms (2L) in order to tack up or press upwardly the four sides of the reversed trim cover assembly, turning it over again and thereby covering the corresponding four side surfaces of cushion member therewith.

As understandable from FIGS. 1 and 2, the four mechanisms (2F) (2R) (2L) are arranged upon an upper base plate (22) such that they surround the above-described temporary securing mechanism (10, 11, 12, 13).

The upper base plate (22) is fixedly supported on the two cylinder rods (23*a*) respectively of paired first cylinders (23). The first cylinders (23) are fixed on a lower base plate (24) which is in turn fixedly connected to the two cylinder rods (25*a*) respectively of paired second cylinders (25). Each of the second cylinders (25) are fastened from the reverse sides respectively of the two support frames (60A-1). As seen in FIG. 3, the upper base plate (22) is formed, in its center area, with a through hole (22A) through which there passes the cylinder (15) of the foregoing temporary securing mechanism without contact therewith, hence allowing the vertical movement of the present guide mechanisms (2F) (2R) (2L) independently of that temporary securing mechanism. Accordingly, operation of such first and second cylinders (23) (25) causes all the four guide mechanisms (2F) (2R) (2L) to be bodily displaced upwardly and downwardly in the height-wise longitudinal direction of the frameworks.

Figure 4:
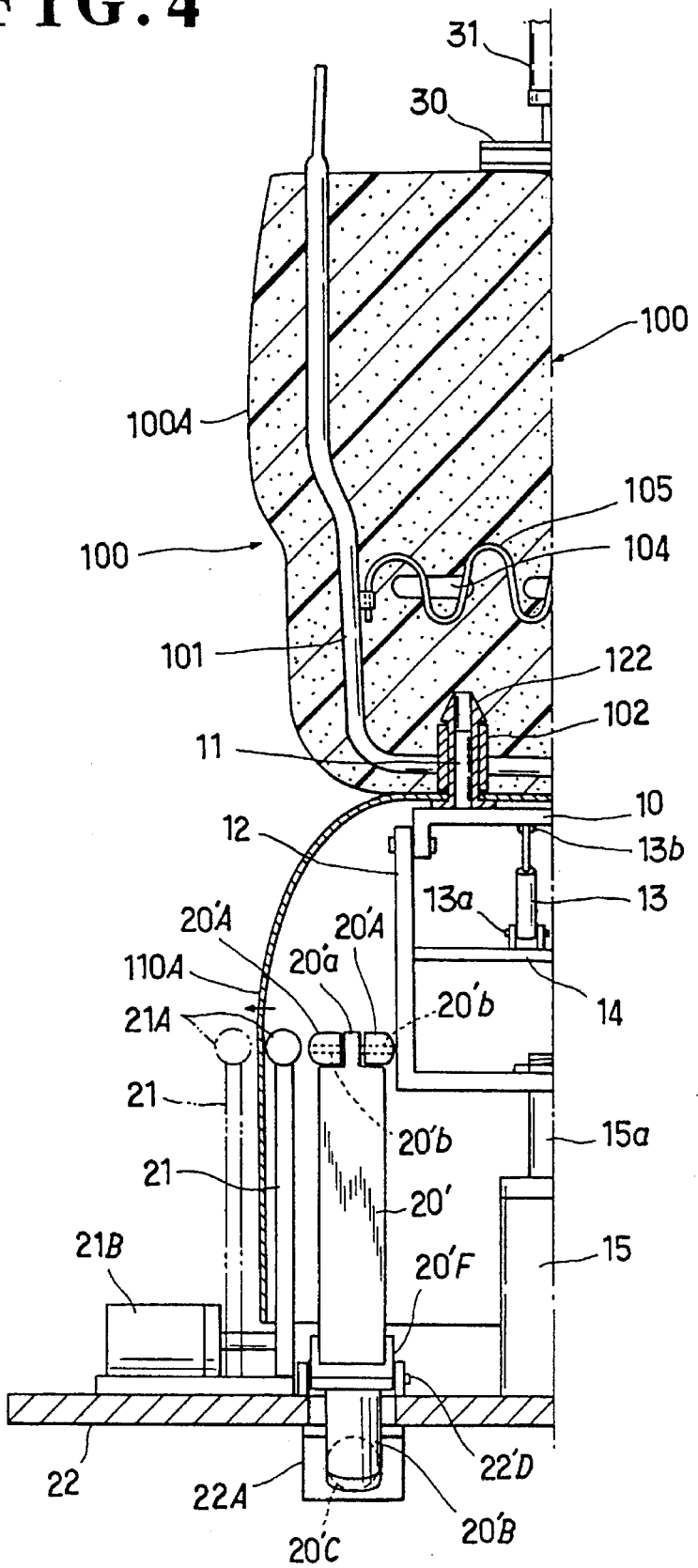
FIG. 4 is a longitudinal sectional fragmentary front view of a temporary securing mechanism in the system, showing a half part thereof, including a half part of a cushion member and trim cover assembly secured thereon.

Specifically, referring to FIGS. 3, 4 and 7 in conjunction with FIG. 1, the rearward guide mechanism (2R) is shown as comprising: a pair of upright standing guide plate members (20'), each having a pair of rollers (20'A) fixed rotatably on the upper end thereof; a support member (20'F) on which the guide plate member (20') is fixedly supported, the support member (20'F) being rockably connected via a pivot (20'D) to a movable base plate (22) so that the guide plate member (20') may be inclined forwardly and backwardly in a direction toward and away from the base bracket (12) or inclinable bracket (11), as indicated by the arrow in FIG. 3; and a cylinder (20'C) fixed on a bracket (22A) fastened from the reverse side of the movable base plate (22), the cylinder (20'C) having a cylinder rod (20'C-1) pivotally connected to a cylinder (20'B) fixed to the reverse side of the support member (20'F) . Hence, operation of the cylinder (20'C) causes the forward and backward inclination of that guide plate member (20') relative to the pivot (20'D). Designation (20'E) denotes a stopper limiting the backward inclination of the guide member (20').

The forward guide mechanism (2F), which is disposed in an opposedly facing relation with the foregoing rearward guide mechanism (2R) as in FIG. 3, is comprised of: a pair of uprightly standing guide plate members (20), each being slidably mounted on the base plate (22) and having a pair of rollers (20A) fixed rotatably on the upper end thereof; and a cylinder (20B) for moving the guide plate member (20) in a direction toward and away from the front side of both inclinable and base brackets (10) (12) in contrast to the rearward guide mechanism (2R).

The two lateral guide mechanisms (2L) (2L), which are located on the opposite sides of the base bracket (12) associated with the temporary securing mechanism, are each comprised of: an upright standing guide plate (21), similar to that of (20) of the forward guide mechanism (2F), the guide plate (21) being slidably mounted on the base plate (22) and having a pair of rollers (20A) (20A) fixed rotatably on the upper end thereof; and a cylinder (21B) for moving the guide plate member (21) in a direction toward and away from the lateral side of both inclinable and base brackets (10)(12).

In general, the aforementioned paired rollers (20A, 20'A, 21A) provided on each of the guide plate members (20, 20', 21) are rotatably journalled by a pin and the pin is fixed in the upper projected portion each of the guide plate members, as typically shown in FIG. 4. Namely, although all the rollers are not shown clearly in the drawings, the general construction thereof should be understood from the rollers (20'A) provided on the rearward guide plate member (20') as in the FIG. 4. Specifically, the guide plate (20') is formed at its upper end with an upwardly projected portion (20'*a*) such that both two upper corner portions of the guide plate member (20') are cut away. In those cut-away two corner portions, the two separate rollers (20'A) (20'A) are respectively disposed. This formation is effective in allowing the guide plate members to smoothly tack up the trim cover assembly (110) onto the cushion member (100) without interference between the trim cover assembly and guide plate members during operation of the present system. That is, the rollers prevent the trim cover assembly (110) from being caught in the guide plate members. Preferably, each roller is formed from a hard silicone resin material.

A foot switch (70) is provided, which is electrically connected with a computerized control device (not shown) for controlling all the above-described mechanisms and devices. Hence, it is to be understood, although not shown in the drawings, that the control device is electrically connected with all the cylinders of all the mechanisms and devices described above. The switch (70) is operable to select one of a fully automated mode or a two-step manual mode for operating the present system. Namely, in the fully automated mode, simply by depressing "on" the foot switch (70), all the mechanisms and devices described above are automatically activated in sequence according to a predetermined steps of covering process stored in memory of the not-shown control device, which will be described later. Alternatively, in the two-step manual mode, the foot switch (70) may be released "off" at a certain step for manual hog ring fitting purpose and thereafter a second switch (71) may be turned on for executing the remaining steps. In this respect, as shown in FIG. 1, the second switch (71) is provided on the forward vertical frame section (61A) and also electrically connected with the not-shown computerized control device so as to actuate the cylinders adapted to execute such remaining steps subsequent to the manual hog ring fitting steps, which will also be elaborated later.

Now, a description will be made of how the above-described covering system is operated.

First of all, as far as the present embodiment is concerned, an object to be processed by the covering system described above is a seat-back foam cushion member (100) that has a pair of headrest stay holders (122) provided therein for permitting the headrest (130) to be mounted on the upper end thereof as shown in FIG. 10.

As stated previously, before operating the covering system, the suck-like trim cover assembly (110) should be turned inside out as indicated by the two-dot chain line in FIG. 10, so that the reverse side thereof appears externally with the anchor member (115) dependent therefrom as can be seen in FIG. 7. Such turned-over cover material (110) should also be secured at the top section (110D) thereof onto the top portion (100D) of the cushion member (100) by means of the two stay holders (122) (122) as understandable from both FIGS. 10 and 4. This non-processed, combined state of cushion member (100) and trim cover assembly (110) shall be referred to as an "incomplete seat unit" hereinafter.

At a first step of operating the covering system, the inclinable securing bracket (10) of the temporary securing mechanism should be set at the forwardly inclined position as indicated by the two-dot chain line in FIG. 3.

Then, the top portion (i.e. 100D, 110D) of the foregoing incomplete seat unit is temporarily secured onto the thus-forwardly-inclined securing bracket (10) by letting the two support rods (11) of the bracket (10) be inserted into the respective two stay holders (122) (122) in the incomplete seat unit, as understandable from FIGS. 4 and 7 Thus, the cushion member (100) is in the turned upside-down state upon the bracket (10). At the same time, the trim cover assembly (110) should be set dependent from the top portion of cushion member (100) such as to expand downwardly over both upper part (10, 11, 15) of the temporary securing mechanism and guide plate members (20, 20', 21) of covering guide mechanism, as in FIGS. 4 and 7. It is therefore seen that both brackets (10) (12) and all the guide plate members (20, 20', 21) are within the trim cover assembly (110).

Then, by depressing "on" the foot switch (70), the cylinder (13) is actuated to rotate back the inclinable securing bracket (10) to the upright position, thereby orienting the lower end of cushion member (100) toward the cushion member securing device (30), and actuating the cylinder (31) to lower the securing device (30) toward the thus-upwardly-oriented lower end of cushion member (100). The securing device (30) is automatically moved to grasp that lower end of cushion member (100). Accordingly, the cushion member (100) is temporarily secured at its upper and lower ends by means of both the temporary and cushion member mechanisms, as shown in FIG. 4.

Then, the cylinders (20B) (20'C) (21B) associated with the covering guide mechanism are all simultaneously actuated to move the corresponding guide plate members (20) (20'C) (21) a slight distance in the outward directions away from the centrally disposed brackets (10) (12), as indicated by the two-dot chain lines and the arrows in both FIGS. 4 and 7, thereby expanding outwardly the four sides (100A) (100B) (100C) of trim cover assembly (110) to a slight degree, so that the cushion member (100) is ready to be covered easily with the trim cover assembly (110).

Thereafter, as indicated by the arrows in FIG. 5, the temporary securing mechanism, cushion member securing mechanism, and covering guide mechanisms are automatically operated at one time to cause the cushion member (100) to be covered with the trim cover assembly (110). More specifically, as in FIG. 5, the paired upper cylinders (33) associated with the cushion securing mechanism and the first cylinder (15) associated with the temporary securing mechanism are moved in synchronism with each other to lower the cushion member (100) in the downward arrow directions, while at the same time, the paired first cylinders (23) associated with the covering guide mechanism are actuated to raise all the four guide plate members (20, 20', 21) in the upward arrow directions. Thus, the turned-over trim cover assembly (110) is gradually pushed upwardly by those guide plate members (20) (20') (21) and also pressed by the rollers (20A) (20'A) (21) of the same guide plate members into a close contact upon the four surfaces (100A) (100B) (100C) of cushion member (100), whereby the trim cover assembly (110) is turned again inside out to thereby start covering the upper part of cushion member (100).

Figure 8:
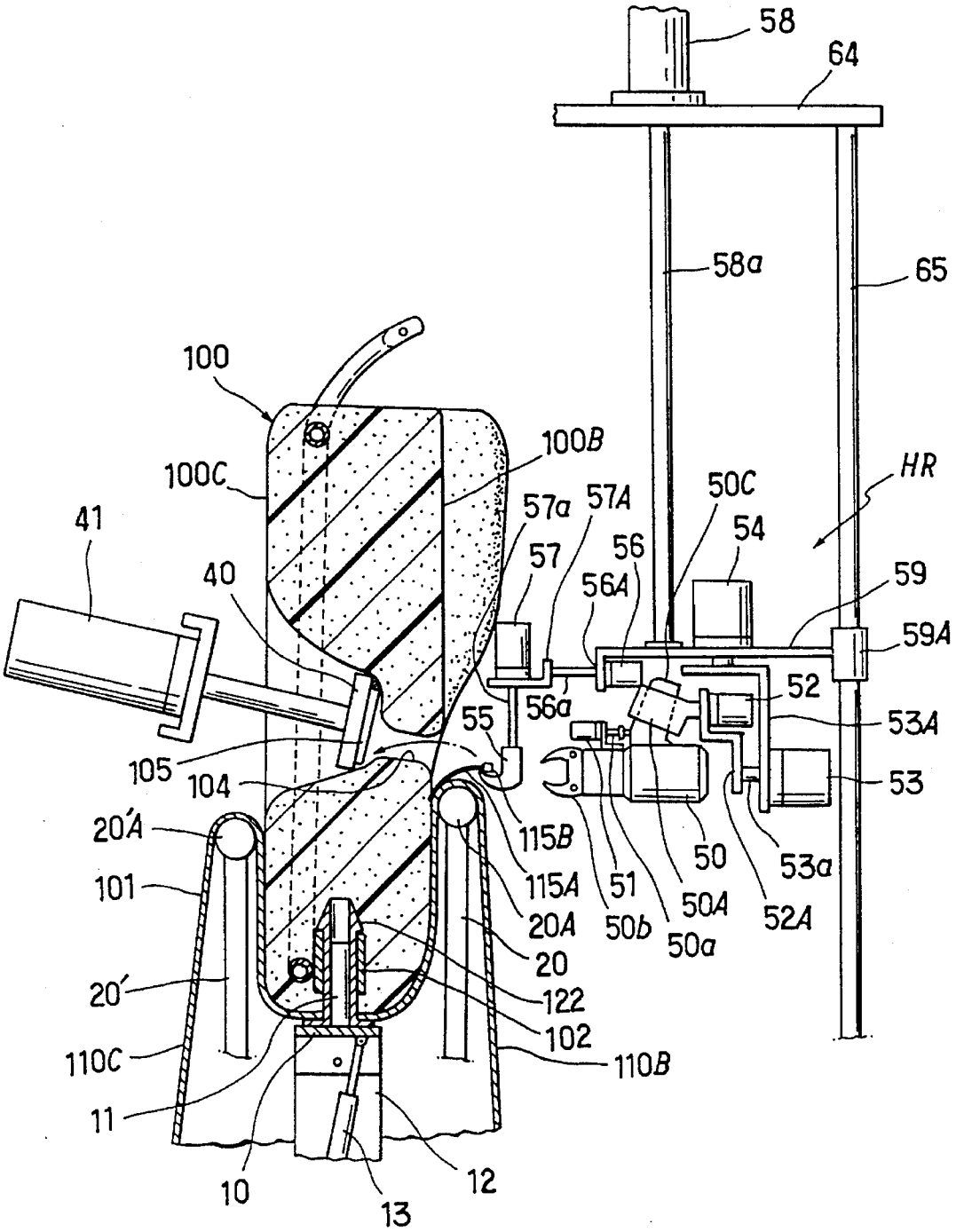
FIG. 8 is a partly broken, longitudinal sectional side view which explanatorily shows a process for securing an anchor member to the cushion member by those principal parts of system in FIG. 7.

When the cushion member (100) is covered with the trim cover assembly (110) by a level corresponding to the slits (104) thereof as in FIG. 5, the cylinder (41) is actuated to bring the pressure plate (40) towards a given target (SP) (see FIG. 9 too) in the rear side (100C) of cushion member (100) in correspondence with the slits (104) so as to press and make thin the corresponding cross-sectional area of cushion member (100), thereby forcibly displacing the sinuous insert wire (105) near to the frontal side (100B) of same cushion member (100), as understandable from FIG. 8. At this moment, as can be observed in the FIG. 8, the inner bore area in each of the slits (104) is expanded widely by the pressing force given from the pressure plate (40), which serves to expose and make accessible the downward valley portion of the insert wire (105) within each of the slits (104). Thus, an operator may turn off the foot switch (70) to conduct the manual two-step operation mode; namely, at this stage, the operator may turn off the foot switch (70) to provisionally stop the operation of the present system, and take up the anchor member (115) dependent from the trim cover assembly (110). The anchor member (115) should be bought to the slits (104), and particularly the anchor head (115B) be pressed thereagainst, while compressing the corresponding region of cushion member (100), so that the anchor head (115B) may be disposed adjacent to the two downward valley portions of insert wire (105). Then, the operator engages hog rings (145) to firmly connect the anchor head (115B) to the insert wire valley portions, as shown in FIG. 12.

Figure 6:
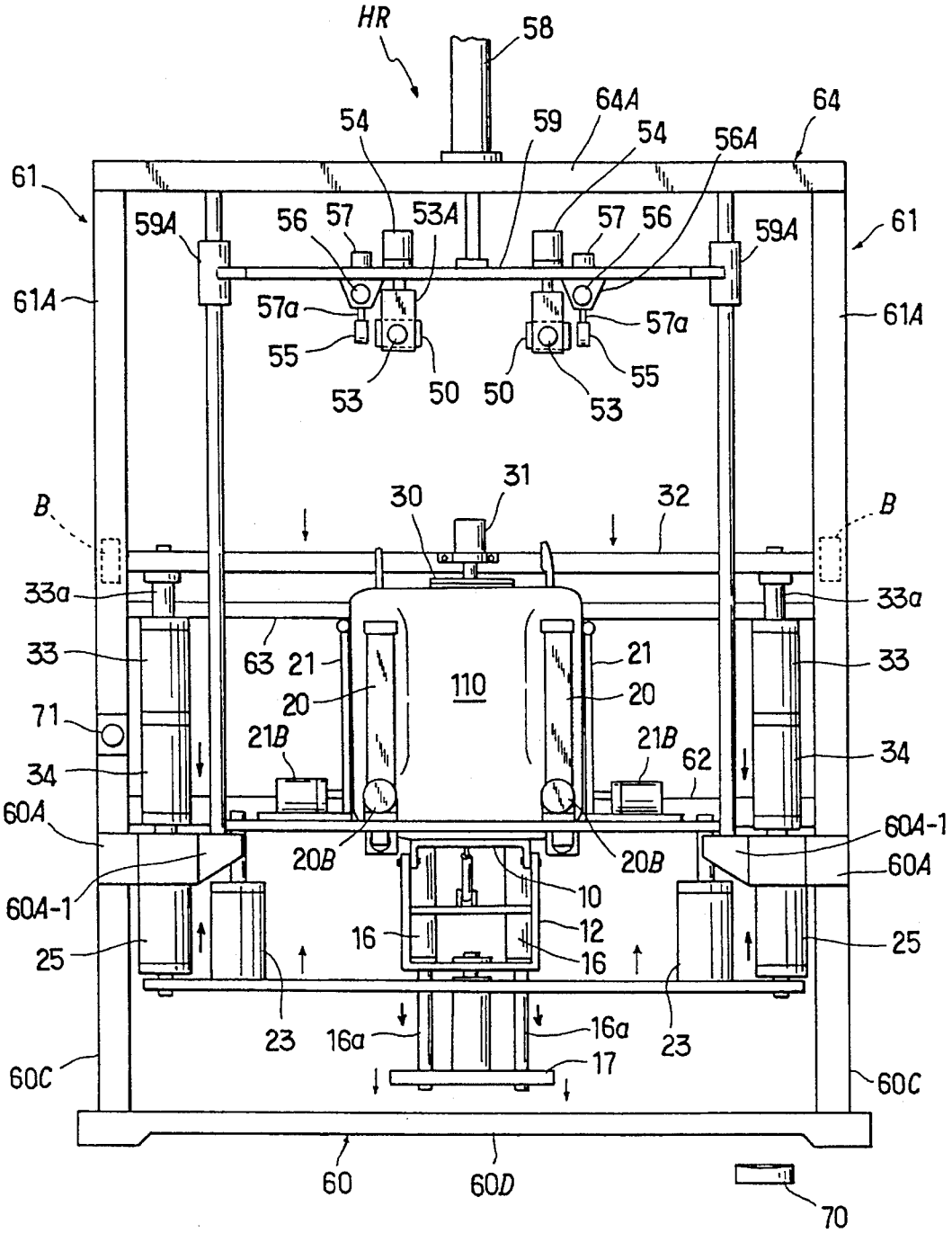
FIG. 6 is a schematic front view of the system, showing its final operation state for covering the cushion member.

After the foregoing manual hog ring fitting or trim cover anchoring steps, the operator should turn on the second switch (71) to execute a second step of operation of the present covering system. Namely, with the second switch (71) turned "on", the cylinder (41) is actuated to withdraw the pressure plate (40) from the rear side of cushion member (105) to a home position, and thereafter, as shown in FIG. 6, the two lower cylinders (34) and the two cylinders (16) are actuated simultaneously to further lower the incomplete seat unit in the downward arrow directions, while at the same time, the two cylinders (16) are actuated to further raise the four guide plate members (20, 20', 21) in the upward arrow directions. As a result, as in FIG. 6, the trim cover assembly (110) is completely turned inside out to cover all the surfaces of the cushion member (100), excepting the lower end of the latter, with the outer surfaces of trim cover assembly (110) appearing outside.

At a few seconds after this covering steps, the cylinders (33, 34) (15) (16) (23, 25) are simultaneously actuated in the reverse directions to return their associated movable members (32) (17) (12) (22) to their respective initial positions shown in FIG. 1. Then, the cushion securing device (30) (e.g. a clamp) is moved to release its retaining of the cushion member (100), allowing the same to be removable therefrom, and simultaneously the cylinder (13) is actuated to cause the inclinable securing bracket (10) to be inclined forwardly upon the base bracket (12) as indicated in FIG. 3. Consequently, the resultant product, i.e. the cushion member (100) covered with the trim cover assembly (110), may be taken out from the present covering system.

The above description is dedicated to the two-step operation of the covering system. Now, the fully automated operation mode will be described, which uses the hog ring fitting mechanism (HR).

In the fully automated operation mode, all required processes including the above-described steps are automatically effected by simply turning on the foot switch (70). In this mode, the manual processes for securing the anchor member (115) in the cushion member (100) are all carried out automatically by the hog ring fitting mechanism (HR). Thus, since all the steps for causing the cushion member (100) to be covered with the trim cover assembly (110) has been described above, a repetition of same explanation thereon will not be made hereinafter, and specific description will be made only in regard to the operation of the hog ring fitting mechanism (HR) and some of other operations shortly before and after the hog ring fitting or anchor member securing steps by the hog ring fitting mechanism (HR).

Referring now to FIG. 5, the incomplete seat unit secured to both the temporary securing and cushion member securing mechanisms is shown as having undergone a certain steps of covering process. In other words, the trim cover assembly (110) is shown as being tucked up by the four guide plate members (20, 20', 21) to cover the upper half portion of the cushion member (100) where the slits (104) are formed.

In contrast to the above-mentioned two-step mode, at this particular stage, all the associated cylinders (15, 23, 33) having worked thus far are suspended their operations to stop the covering of trim cover assembly (110) at the previously stated target point (SP) for securing the anchor member (115) in the cushion member (100). At this point of time, as similar to the foregoing two-step operation mode, the cylinder (41) is actuated to move the pressure plate (40) towards the target point (SP) in the rear side of cushion member (100), thus pressing and making thin that particular area of cushion member (100) in order not only to forcibly bring the valley portions of insert wire (105) to a point adjacent to the frontal side (100B) of cushion member (100), but also to widen the inner bore areas of the slits (104), making thus easily accessible those insert wire valley portions, as indicated in FIG. 8. During this process, the cylinder (58) associated with the hog ring fitting mechanism (HR) is actuated to lower the previously described two hog ringer assemblies towards such target point (SP) where the slits (104) exist, as understandable from FIGS. 7 and 8.

Upon the hog ringer assemblies reaching that point (SP), through a computerized control, the associated mechanisms in each of the hog ringer assemblies are operated in sequence to secure the anchor member (115) to the insert wire (105). Now, for the sake of simplicity, description will be given only with regard to one of the two hog ringer assemblies. Of course, both two hog ringer assemblies are operated simultaneously to perform the same actions. Referring to FIGS. 7 and 8, when the hog ringer assembly reaches the point (SP), the horizontal transfer cylinder (56) is worked to adjust the fore-and-aft horizontal position of the hook member (55) with respect to the cushion member (100) and the elevation cylinder (57) is continuously moved to adjust the vertical position of the same hook member (55) so as to cause the anchor head (115B) of anchor member (115) to be hookingly caught by the hook member (55), as shown in FIG. 8. Then, the second cylinder (54) associated with the hog ring device (50) is moved to adjust the vertical position of hog ring device (50) so that the jaw portion (50*b*) thereof is located in alignment with the anchor member's head (115B) received on the hook member (55), after which, the first cylinder (53) are actuated to move the hog ring device (50) forwardly towards both anchor member (115) and slits (104). Thus, during such forward displacement of the hog ring device (50), the anchor head (115B) is caught in the jaw portion (50*b*) of hog ring device, and then the cylinder (52) is continuously moved to cause further forward movement of the hog ring device (50) together with the anchor member (115) , so that the anchor members head (115B) is forcibly pressed against the area of cushion member (100) where the slit (104) lies, and is thereby located adjacent to the valley portion of insert wire (105) through the slit (104). At this point, the hog ring device's jaw portion (50*b*) is contacted with the pressure plate (40) , extending over both the anchor head (115B) and insert wire valley portion and being thus ready to fit over them a hog ring (145) stored in the hog ringer device (50) . The trigger cylinder (56) is then actuated to energize the hog ringer device (50) to shot and fit the hog ring (145) over both anchor head (115B) and valley portion of insert wire (105). Consequently, as can be seen in FIG. 12, the anchor member (115) is secured to the insert wire (105).

In this context, it may be so arranged that the point where the anchor head (115B) is caught by the hog ring device's jaw portion (**50*b*) is set slightly lower than the foregoing point at (SP) by about 10–15 mm, and that both hook and hog ring devices (55) (50) are firstly displaced to such lower target point through operations of the cylinders (58) (54), after which, by reverse operation of the cylinder (54), the hog ring device (50) is raised back, the same distance of about 10 –15 mm, toward the normal target point (at SP). This arrangement insures to permit the hook member (55) to positively retain the anchor member's head (115B) therein, avoiding the likelihood of the anchor head (115B) being accidentally falling out of the hook member (55**).

After such automated anchor member securing process, the four cylinders (41) (56) (52) (53) are actuated in the reverse direction so as to withdraw their associated members (40) (55) (50) back to their respective initial positions (see FIG. 2). Thereafter, the hog ringer assemblies are bodily raised by reverse operation of the cylinder (58) toward the initial position shown in FIG. 2. All other subsequent operations are carried out in the same manner as explained previously in the two-step manual operation mode.

Accordingly, in both of the two-step manual and fully automated operation modes, the anchor member (115) may be secured to the insert wire (105) within the cushion member (100), as shown in FIG. 12, whereby the anchor member (115) functions to forcibly bring the trim cover assembly frontal section (110B) to a close contact upon both flat central surface (110B) and two outwardly projected bolster portions (110A), thereby achieving a neat covering of the unevenly surfaced cushion member (100) with the sack-like trim cover assembly (110).

In addition thereto, according to the present invention, the provision of the temporarily securing mechanism having two support rods (11) permits for direct use of such ordinary seat back with two headrest stay holders (see (122) in FIG. 10), and simply by inserting the support rods (11) into the headrest stay holders (122), respectively, it is readily possible to precisely locate both bracket (10) and cushion member (100) with respect to the opened side of trim cover assembly (110), thereby completely preventing the relative dislocation between the cushion member and trim cover assembly. Hence, the cushion member (100) is transferred stably into the trim cover assembly (110), while the trim cover assembly is also stably guided to cover the cushion member (100) with great precision.

In FIG. 2, designation (**24*a*) stands for a cut-away portion formed in the lower base plate (24), which allows the base plate (17) of temporary securing mechanism to be pass therethrough, as shown in FIG. 6**.

With regard to the four guide plate members (20) (20') (21), the present embodiment shows the two different kinds of mechanism for them: namely, horizontally movable ones (20)(21) and rotatable ones (20'). But, this is not limitative, and any arrangement of those different guide plate mechanisms may be made as desired. The rotatable guide plate members (20') (20') is advantageous in that they are fixed at a given center of rotation and therefore do not need space for fore-and-aft movement with respect to the temporary securing mechanism as compared with the horizontally movable guide plate members (20, 21) which need such fore-and-aft movement space.

While having described the present invention as above, it should be understood that the invention is not limited to the illustrated embodiment, but any other modifications, replacements and additions may be structurally applied thereto.

What is claimed is:

1. A system for covering a cushion member with a trim cover assembly, in which the trim cover assembly is formed in a sack-like configuration having a top section, a first side section, a second side section facing said first side section, an interior surface, an exterior surface and a pair of lateral sections, said trim cover assembly further having an anchor device on an inside surface of said second side section, the cushion member being formed from a foam material having an upper wall, lower wall and four side walls and further including an anchoring point, to which said anchor device is to be secured, said system comprising:

a first movable securing and support means for temporarily securing and supporting thereon said upper wall of said cushion member and said top section of said trim cover assembly at a predetermined position, wherein said interior surface of said trim cover assembly is turned outwardly thereby rendering said interior surface outwardly facing when secured on said first movable securing and support means;

a second movable securing and support means for temporarily securing and supporting thereon said lower wall of said cushion member;

a first drive means for causing said first movable securing and support means and said second movable securing and support means to be moved in a first direction;

a covering guide means for supporting and guiding said trim cover assembly and turning said outwardly facing interior surface inwardly onto said four side walls of said cushion member, said covering guide means being arranged so as to surround said first movable securing and support means:

said covering guide means comprising;

a first guide element for pressing and guiding said first side section of said trim cover assembly alongside of said first movable securing and support means;

a second guide element for pressing and guiding said second side section of said trim cover assembly alongside of said first movable securing and support means; and a pair of third guide elements, each pressing and guiding a respective lateral section of said pair of lateral sections of said trim cover assembly;

a pressing means for applying a pressure to a part of said cushion member corresponding to said anchoring point, thereby rendering said part of said cushion member thin, to make said anchoring point accessible;

a second drive means for moving said covering guide means in a second direction opposite to said first direction; and a switch means operable to start and stop said first drive means and said second drive means and to activate said pressing means;

wherein said covering guide means and said first movable securing and support means and said second movable securing and support means may be moved toward each other through said first drive means and said second drive means by operation of said switch means so as to cause said first side section, said second side section and said paired lateral sections of said outwardly facing interior surface to be turned inwardly by said first guide element, said second guide element and said pair of third guide elements onto said four side walls of said cushion member, and said pressing means may be activated by operation of said switch means to make said anchoring point of said cushion member and permitting said anchor means of said trim cover assembly to be manually secured to said anchoring point, wherein said cushion member is precisely and neatly covered with the trim cover assembly with said anchor means being secured to said anchoring point.

2. The system as defined in claim 1, wherein said cushion member forms an uneven seat shape including a flat portion and at least one projected portion, and wherein said anchoring point of said cushion member is defined in said flat portion.

3. The system as defined in claim 1, wherein an insert wire is provided in said anchoring point of said cushion member, and wherein said pressing means is operated to press said anchoring point so as to make said insert wire, accessible so that said anchor means can be manually secured to the insert wire by means of a hog ring.

4. The system as defined in claim 1, wherein said upper wall of said cushion member is provided therein with at least one headrest stay holder into which a stay of a headrest is to be fitted, wherein said top section of said trim cover assembly is formed with at least one hole in correspondence with said at least one headrest stay holder, and wherein said first moveable securing and support means has a support rod which may be inserted into said at least one headrest stay holder and said at least one hole when said cushion member and trim cover assembly are secured on said first movable securing and supporting means.

5. The system as defined in claim 1, wherein said first movable securing and supporting means further has an rotatable bracket inclinable to a position where both said cushion member and trim cover assembly can be secured on the bracket.

6. The system as defined in claim 1, wherein said switch means comprises a first switch operable to start and stop said first drive means and said second drive means, and a second switch operable to activate said pressing means, wherein said covering guide means and both said first movable securing and support means and second movable securing and support means are stopped by operation of said first switch when said cushion member is covered with said trim cover assembly to a certain degree, and thereafter said pressing means is activated by operation of said second switch, thereby permitting said anchor means of said trim cover assembly to be manually secured to said anchoring point of said cushion member.

7. The system as defined in claim 1, wherein said first guide element, said second guide element and said pair of third guide elements are displaceable in a direction towards and away from said first movable securing and supporting means.

8. The system as defined in claim 1, wherein each of said first guide element, said second guide element and said pair of third guide elements comprises an upright standing guide plate member having two upper cut-away corner portions, and a pair of rollers, each of said pair of rollers being rotatably supported in a respective one of said two upper cut-away corner portions.

9. A system for covering a cushion member with a trim cover assembly, in which the trim cover assembly is formed in a sack-like configuration having a top section, a first side section, a second side section facing said first side section, an interior surface an exterior surface and a pair of lateral sections, said trim cover assembly further having an anchor device on an inside surface of said second side section, the cushion member being formed from a foam material having an upper wall, lower wall and four side walls and further including an anchoring point, to which said anchor device is to be secured, said system comprising:

a first movable securing and support means for temporarily securing and supporting thereon said upper wall of said cushion member and said top section of said trim cover assembly at a predetermined position, wherein said interior surface of said trim cover assembly is turned outwardl thereby rendering said interior surface outwardly facing when secured on said first movable securing and support means;

a second movable securing and support means for temporarily securing and supporting thereon said lower wall of said cushion member;

a first drive means for causing said first movable securing and support means and said second movable securing and support means to be moved in a first direction;

a covering guide means for supporting and guiding said trim cover assembly and turning said outwardly facing interior surface inwardly onto said four side walls of said cushion member, said covering guide means being so arranged as to surround said first movable securing and support means:

said covering guide means comprising;

a first guide element for pressing and guiding said first side section of said trim cover assembly alongside of said first movable securing and support means;

a second guide element for pressing and guiding said second side section of said trim cover assembly alongside of said first movable securing and support means; and a pair of third guide elements, each pressing and guiding a respective lateral section of said pair of lateral sections of said trim cover assembly;

a pressing means for applying a pressure to a part of said cushion member corresponding to said anchoring point, thereby rendering said part of said cushion member thin to make said anchoring point accessible;

a second drive means for causing said covering guide means to be moved in a direction opposite to said first direction in which said first and second securing means are moved by said first drive means;

said cushion member having an insert wire provided at said anchoring point; and a hog ring fitting means for fitting a hog ring over both said anchor means of said trim cover assembly and said insert wire of said cushion member, said hog ring fitting means being movable to catch and bring said anchor means towards said insert wire;

wherein said first drive means and said second drive means are operable to cause said covering guide means and said first movable securing and support means and said second movable and support securing means to be moved toward each other so as to cause said first side section, said second side section and said pair of said lateral sections of said outwardly facing interior surface to be turned inwardly by said first guide element, said second guide element and said pair of third guide elements onto said four side walls of said cushion member, with said pressing means activated to render said part of said cushion member thin corresponding to said anchoring point, making said insert wire accessible, wherein said hog ring fitting means is operable to catch and bring said anchor means towards said insert wire and fit said hog ring over both said anchor means and hog ring to thereby secure the anchor means to the insert wire, wherein said cushion member is precisely and neatly covered with said trim cover assembly, with said anchor means of said trim cover assembly being secured to said anchoring point of said cushion member, in a fully automated manner.

10. The system as defined in claim 9, wherein said hog ring fitting means comprises a hog ring device having a jaw portion and a hook device disposed forwardly of said jaw portion, and wherein, in operation, after said pressing means has been activated in a direction to apply a pressure to said part of said cushion member corresponding to said anchoring point, said hook device is operated to hookingly catch and retain said anchor means in front of said hog ring device, and thereafter said hog ring device is operated so as to extend the jaw portion thereof over both said anchor means and insert wire, and fit said hog ring around them.

11. The system as defined in claim 9, wherein said first guide element, said second guide element and said pair of third guide elements are displaceable in a direction towards and away from said first movable securing and supporting means, and wherein said hog ring fitting means is movable in a direction towards and away from a point generally corresponding to a position where said pressing means is activated to render said part of said cushion member thin to make said insert wire accessible.

12. The system as defined in claim 9, wherein each of said first guide element, said second guide element and said pair of third guide elements comprises an upright standing guide plate member having two upper cut-away corner portions, and a pair of rollers, each of said pair of rollers being rotatably supported in a respective one of said two upper cut-away corner portions.

* * * * *